US005091639A

United States Patent [19]

Heumann

[11] Patent Number: 5,091,639

[45] Date of Patent: Feb. 25, 1992

[54] MOUNT FOR AN ELECTRODE SYSTEM IN AN X-RAY IMAGE INTENSIFIER

[75] Inventor: Reiner Heumann, Spardorf, Fed. Rep. of Germany

[73] Assignee: Siemens Aktiengesellschaft, Munich, Fed. Rep. of Germany

[21] Appl. No.: 649,975

[22] Filed: Feb. 4, 1991

[30] Foreign Application Priority Data

Mar. 6, 1990 [EP] European Pat. Off. ..... 90104289.5

[51] Int. Cl.[5] ..... H01J 31/50

[52] U.S. Cl. ..... 250/213 VT; 313/103 CM; 313/105 CM; 378/99; 358/111

[58] Field of Search ..... 250/213 VT; 378/99, 378/62; 358/111; 313/529, 451, 456, 417, 292, 103 CM, 105 CM

[56] References Cited

U.S. PATENT DOCUMENTS

| | | | |
|---|---|---|---|
| 2,523,406 | 9/1950 | Wilder | 313/451 |
| 3,809,889 | 5/1974 | McBroom | 250/213 VT |
| 3,835,314 | 9/1974 | Grossel et al. | 250/213 VT |
| 3,895,250 | 7/1975 | Chrisgau et al. | 313/529 |
| 4,140,900 | 2/1979 | Wang | 250/213 VT |
| 4,315,184 | 2/1982 | Santilli et al. | 313/529 |
| 4,554,479 | 11/1985 | Opresko | 313/417 |
| 4,585,935 | 4/1986 | Butterwick | 250/213 VT |
| 4,831,249 | 5/1989 | Van Der Valden et al. | 250/213 VT |
| 4,868,455 | 9/1989 | Vrijssen | 313/456 |
| 4,960,987 | 10/1990 | Frank | 250/213 VT |
| 5,028,842 | 7/1991 | Ricodeau et al. | 313/529 |

*Primary Examiner*—Carolyn E. Fields
*Assistant Examiner*—Drew A. Dunn
*Attorney, Agent, or Firm*—Hill, Van Santen, Steadman & Simpson

[57] ABSTRACT

A mount for attaching an electrode system, which focusses electrons generated upon the incidence of x-rays on an input luminescent screen onto an output luminescent screen, to an exterior housing of the intensifier is formed by annular electrodes which telescopically engage and which are held together at overlapping regions by a clamped connection. The mount has a simple structure which minimizes the possibility of the electrode system getting out of adjustment, and also significantly decreases the assembly time during manufacture of the x-ray image intensifier.

13 Claims, 1 Drawing Sheet

MOUNT FOR AN ELECTRODE SYSTEM IN AN X-RAY IMAGE INTENSIFIER

BACKGROUND OF THE INVENTION

1. Field of the Invention

The present invention is directed to an x-ray intensifier having an electrode system for focusing the electrons generated on a input luminescent screen by the incidence of x-rays thereon, onto an output luminescent screen.

2. Description of the Prior Art

X-ray image intensifiers are used in x-ray diagnostics for converting an x-ray shadow image, produced by irradiating a patient with x-rays, into a visible image. A video camera tube is connected to the output of the x-ray image intensifier, the output signals of this tube being supplied to a monitor via a video chain. The examination region is displayed as a picture on the monitor.

A known x-ray image intensifier is described in the book "Das Roentgenfernsehen," Bauer et al., 1974, pp. 54–56. This known x-ray image intensifier has a vacuum vessel with an input luminescent screen with a photocathode disposed at one end face and an output luminescent screen disposed at the other end face. An electrode system is disposed between the screens for accelerating and focusing electrons generated by the incidence of x-rays on the input luminescent screen onto the output luminescent screen. The electrode system is formed by a plurality of cylindrical or annular electrodes having respectively different diameters, to which different voltages are applied for focusing the electrons generated at a point of the input luminescent screen onto a corresponding point of the output luminescent screen. These electrodes are in the form of cylindrical rings, and are respectively secured to the inside wall of the vacuum vessel by a mount.

In this known structure, at least one mount must be provided for each electrode, the mount being in mechanical connection with the inside wall of the vacuum vessel. Such an electrode system is extremely complex to manufacture, because a specific mount is required for each electrode. Moreover, the assembly time is significant, because the electrodes must be individually adjusted.

SUMMARY OF THE INVENTION

It is an object of the present invention to provide a mount for an electrode system in an x-ray image intensifier which is simple to manufacture and which requires a low assembly time.

The above object is achieved in accordance with the principles of the present invention in a mount for an x-ray image intensifier wherein the electrode system has an annular electrode which is held by an annular mount with a clamped joint between the electrode and the mount. As used herein the term "clamped" encompasses a joint wherein one of the parts is mechanically compressed so as to fit tightly against the other part.

The various embodiments have in common that an electrode, or at least a cylindrical portion thereof, telescopically fits inside a cylindrical portion of a mounting element, the cylindrical portion of the mounting element having an interior diameter which is slightly larger than the exterior diameter of the cylindrical portion of the electrode. The mounting element may be a cylindrical portion of a further electrode, thereby permitting a plurality of electrodes to be mounted together in telescoping fashion. The mounting element may alternatively be a portion of the wall forming the exterior of the x-ray image intensifier.

In one embodiment, the cylindrical portion of the mounting element is heated, thereby causing it to expand slightly so that the cylindrical portion of the electrode can be easily inserted therein. If the electrode is to be maintained electrically insulated from the mounting element, the overlapping cylindrical portions of the mounting element and the electrode can be provided with respective channels which are in registry when the two components are properly fitted. The channel can hold an insulating member such as a shaped ceramic member, which may be, for example ceramic spheres, a ceramic ring or segments of a ceramic ring. The insulating member in the channel is sufficiently thick so as to prevent the overlapping surfaces of the mounting element and the electrode from touching.

In a further embodiment, the electrode may be provided with a plurality of leaf springs at its periphery which are formed by respective pairs of parallel axial cuts in the electrode. The leaf springs project slightly from the outer surface of the electrode, and when the electrode is inserted inside the mounting element, the leaf springs engage the mounting element to hold the electrode in place. The leaf springs may have projections thereon which are held by spring tension in corresponding recesses in the mounting element, or the mounting element may be provided with projections which engage corresponding channels in the electrode.

The advantage of the mount disclosed herein is that soldering of the opposite ends of the mount element respectively to the electrode and to the outer wall of the x-ray image intensifier is avoided. A conventional mount of that type can be damaged by jolts, with the consequence that the electrode becomes detached from the mount, or that the electrode is moved out of adjustment. Mounting of the electrode in accordance with the mount disclosed herein by clamping requires only a short assembly time, and no separate mount components need be manufactured. The risk of damage to the mount or shifting in the position of the mount causing the electrode to move out of adjustment is reduced.

In the embodiment described above wherein the mount element is a further electrode, and wherein a series of such electrodes are telescopically fitted together, an especially simple structure results because additional mounting components as are needed in conventional structures for each electrode are eliminated, thereby requiring fewer parts to be situated in the vacuum vessel, so that the stability of the high-vacuum is improved.

DESCRIPTION OF THE PREFERRED EMBODIMENTS

Figure 1:
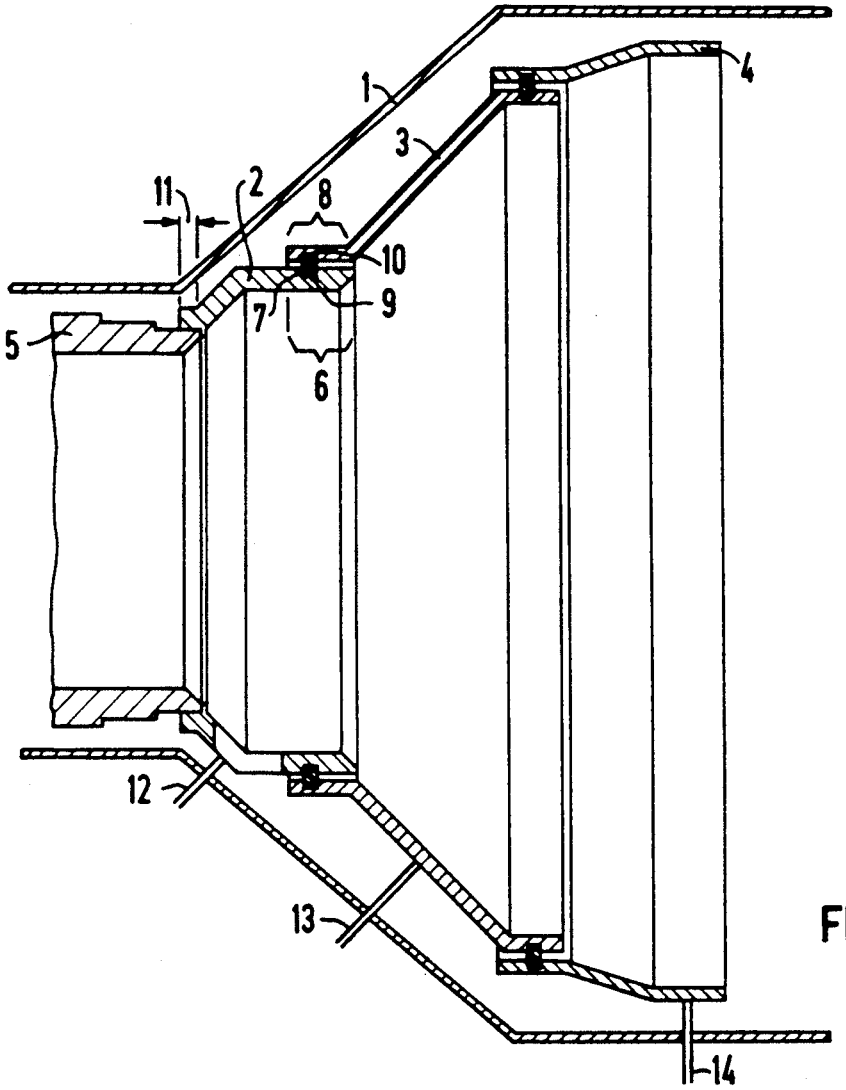
FIG. 1 is a side sectional view of a portion of an x-ray image intensifier having a mount for an electrode constructed in accordance with the principles of the present invention.

A portion of an x-ray image intensifier is shown in FIG. 1 identifying the components thereof necessary for explaining the principles of the present invention. The x-ray image intensifier has a substantially cylindrical outer jacket or housing 1. A first electrode 2, a second electrode 3 and a third electrode 4, forming the electrode system for the x-ray image intensifier, are situated within the jacket 1. A mounting element 5 for the first electrode 2 is provided. The output luminescent screen (not shown) follows to the left of the mount element 5, and the input luminescent screen (not shown) of the x-ray image intensifier follows to the right of the third electrode 4. The first electrode 2 has a region 6 which overlaps a region 8 of the second electrode 3, with an insulating member 7 disposed therebetween. The regions 6 and 8 are cylindrical, with the region 6 having a channel 9 therein and the region 8 having a channel 10 therein, which are disposed opposite each other when the electrodes 2 and 3 are fitted together. The insulating member 7 is a shaped ceramic member situated in the channels 9 and 10, and having a thickness sufficient to maintain a spacing between the electrodes 2 and 3. The insulating member 7 may be, for example, a plurality of ceramic spheres, a ceramic ring, or segments of a ceramic ring.

For assembling the electrode system, a region 11 of the first electrode 2 can be shrunken onto the mount 5. The insulating member 7 is then arranged in the channel 9. The region 8 of the second electrode 3 is warmed, thereby causing that region to expand, and it is slipped over the region 6 of the first electrode 2 and over the insulating member 7. When the region 8 cools, it will shrink onto the region 6 and onto the insulating member 7. The spacing of the regions 6 and 8 from each other is prescribed by the insulating member 7, and is has a dimension so that no voltage arcing will occur between the electrodes 2 and 3, particularly between the regions 6 and 8, during operation of the x-ray image intensifier. The same procedure is undertaken for fastening the third electrode 4 to the second electrode 3.

An electrode system for an x-ray image intensifier which is fast and simple to assemble is thus obtained, wherein mounts for the electrodes which are in communication with the jacket 1 of the x-ray image intensifier can be eliminated. The mounting of the electrodes is so stable at the cylindrical regions 6 and 8 that an impact to the x-ray image intensifier does not cause any of the electrodes to move out of adjustment. Adjustment of the electrodes can even be omitted, because the channels 9 and 10 and the insulating member 7 will correctly position the adjoining electrodes in an optimum arrangement.

Contact pins 12, 13, and 14 respectively connected to the electrodes 2, 3, and 4 are provided which extend through the jacket 1 in a known manner in vacuum-tight fashion to supply voltage to the electrodes 2, 3, and 4.

Because additional mounting components for the electrodes are omitted, fewer parts are situated in the vacuum vessel of the x-ray image intensifier, so that the stability of the vacuum is improved.

Although a plurality of electrodes are shown in the embodiment of FIG. 1, the mounting structure disclosed herein can be used for only a single electrode which is shrunken onto a mounting element. In the embodiment of FIG. 1, the mounting element is another electrode, however, that need not necessarily be so.

Figure 2:
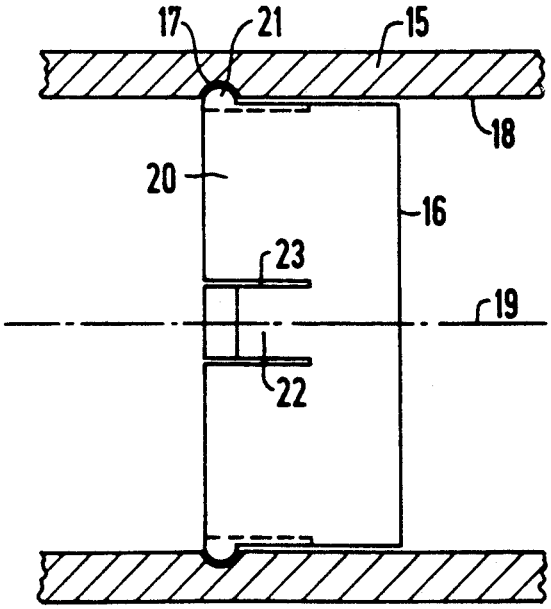
FIG. 2 is a side sectional view of a portion of an x-ray image intensifier with a further embodiment of a mount for an electrode system constructed in accordance with the principles of the present invention.

A further embodiment is shown in FIG. 2, wherein a cylindrical portion 15 of a mounting element has a channel 17 for retaining an electrode 16. This channel 17 is disposed in the inner surface 18 of the cylindrical part 15 of the mounting element, and extends transversely relative to the longitudinal axis 19 of the cylindrical portion 15. It is also possible to provide a plurality of channels 17, spaced from each other, in the surface 18. The outer surface 20, i.e., the surface facing the interior of the cylindrical portion 15, the electrode 16 has resilient springs or clips 22 formed by slots 23 in the surface of the electrode 16. In the assembled condition of the electrode with the mounting element, a bead or projection 21 on the clips 22 engages the channel 17.

For assembly, the electrode 16 is introduced into the cylindrical portion 15 of the mounting element, for example from the left, so that the clips 22 are pressed resiliently inwardly by the bead 21. When the electrode 16 reaches its predetermined position, which is defined by the channel 17, the bead 21 snaps into the channel 17, so that the electrode 16 is positioned and held in the cylindrical portion 15 of the mounting element. It is also possible, however, to provide the electrode 16 with a channel, instead of a bead, and to provide a bead, instead of a channel, on the surface 18. The arrangement shown in FIG. 2 is suitable if the cylindrical portion 15 of the mounting element is not electrically conductive.

If the cylindrical portion 15 of the mounting element is to be electrically conductive, such as when the mounting element is another electrode, an insulating member must be provided between the cylindrical portion 15 and the clip 22. Such an insulating member may be received in the channel 17 of the cylindrical portion 15 or in a recess in the clip 22, so that the insulating member is held clamped between the cylindrical portion 15 and the electrode 16 when the components are in the position shown in FIG. 2.

Although modifications and changes may be suggested by those skilled in the art, it is the intention of the inventor to embody within the patent warranted hereon all changes and modifications as reasonably and properly come within the scope of his contribution to the art.

I claim as my invention:

1. A mounting assembly for an electrode system in an x-ray image intensifier comprising:
   an annular electrode in said electrode system; and
   an annular mounting element for said electrode, said electrode and said mounting element having respective overlapping regions forming a clamped joint holding said electrode and mounting element together.

2. A mounting assembly as claimed in claim 1 further comprising an insulating member clamped between said mounting element and said electrode.

3. A mounting assembly as claimed in claim 2 wherein said electrode has a recess containing said insulating member.

4. A mounting assembly as claimed in claim 2 wherein said mounting element has a recess containing said insulating member.

5. A mounting assembly as claimed in claim 1 wherein said mounting element is a further electrode of said electrode system.

6. A mounting assembly as claimed in claim 5 wherein said further electrode has a region of said annular electrode with an insulating member disposed therebetween in said clamped joint.

7. A mounting assembly as claimed in claim 6 wherein said regions are cylindrical.

8. A mounting assembly as claimed in claim 1 wherein said clamped joint is a joint formed by said mounting element annularly surrounding and tightly overlapping at least a portion of said electrode.

9. A mounting assembly as claimed in claim 1 further comprising an insulating member consisting of shaped ceramic element disposed between said electrode and said mounting element in said clamped joint.

10. A mounting assembly as claimed in claim 1 wherein said electrode has a plurality of spring clips at a periphery thereof and wherein each clip has a first engagement element and said mounting element has a second engagement element, said first and second engagement elements being held together by said spring clips to form said clamped joint.

11. A mounting assembly for an electrode system in an x-ray image intensifier comprising:

at least first and second annular electrodes in said electrode system, said at least first and second electrodes having respective cylindrical regions which fit telescopically together in a clamped joint, and an insulating member disposed between said regions of said at least first and second electrodes in said clamped joint.

12. A mounting assembly for an electrode system in an x-ray image intensifier comprising:

an annular electrode in said electrode system having a plurality of axial pairs of slots therein forming a plurality of spring clips at a periphery of said electrode, each clip having an outward projection thereon; and an annular mounting element fitted over said electrode and having a recess therein into which said projections are forced by said spring clips forming a clamped joint with said electrode.

13. A mounting assembly as claimed in claim 1 wherein said clamped joint is a joint formed by said electrode annularly surrounding and tightly overlapping at least a portion of said mounting element.

* * * * *